US006206096B1

(12) United States Patent
Belik

(10) Patent No.: US 6,206,096 B1
(45) Date of Patent: Mar. 27, 2001

(54) APPARATUS AND METHOD FOR INSTALLING A PIPE SEGMENT IN A WELL PIPE

(76) Inventor: Jaroslav Belik, 4955 Sentry Woods La., Pearland, TX (US) 77584

( * ) Notice: Subject to any disclaimer, the term of this patent is extended or adjusted under 35 U.S.C. 154(b) by 0 days.

(21) Appl. No.: 09/309,346

(22) Filed: May 11, 1999

(51) Int. Cl.[7] ..... E21B 19/18; E21B 19/16

(52) U.S. Cl. ..... 166/77.51; 166/78.1; 166/380; 175/85; 173/164

(58) Field of Search ..... 166/378, 380, 166/77.51, 85.1, 85.5, 78.1; 175/85, 162; 173/164

(56) References Cited

U.S. PATENT DOCUMENTS

| | | | | |
|---|---|---|---|---|
| 2,645,460 | | 7/1953 | Lundeen . | |
| 3,041,901 | | 7/1962 | Knights . | |
| 3,122,211 | * | 2/1964 | Wilson et al. | 173/164 |
| 3,799,009 | | 3/1974 | Guier . | |
| 4,005,621 | | 2/1977 | Turner, Jr. et al. . | |
| 4,348,920 | * | 9/1982 | Boyadjieff | 81/57.25 |
| 4,446,761 | | 5/1984 | Boyadjieff et al. . | |
| 5,000,065 | | 3/1991 | Haynes . | |
| 5,054,550 | | 10/1991 | Hodge . | |
| 5,778,742 | | 7/1998 | Stuart . | |
| 5,791,206 | | 8/1998 | Daigle et al. . | |

* cited by examiner

*Primary Examiner*—David Bagnell
*Assistant Examiner*—Jennifer R. Dougherty
(74) *Attorney, Agent, or Firm*—Harrison & Egbert

(57) ABSTRACT

A spinner apparatus for installing a pipe segment into a well pipe having a frame with a reach area formed therein, a first arm pivotally connected to the frame, a first roller rotatably mounted on the first arm, a second arm pivotally connected to the frame, a second roller rotatably mounted on the second arm, a third arm pivotally connected to the frame, a third roller rotatably mounted on the third arm, and an actuator linked to at least one of the arms so as to pivot one of the arms such that the respective rollers on the arms move into the reach area. Each of the arms is linked together such that a movement of one of the arms causes a concomitant movement of another arm so as to position the rollers around an outer surface of the pipe segment such that the pipe segment will have a central longitudinal axis in an identical position regardless of the diameter of the pipe segment.

25 Claims, 11 Drawing Sheets

APPARATUS AND METHOD FOR INSTALLING A PIPE SEGMENT IN A WELL PIPE

TECHNICAL FIELD

The present invention relates to apparatus and methods for the installation of pipe segments into a well pipe. More particularly, the present invention relates to spinners that are used to thread an end of the pipe segment into an end of the well pipe. Additionally, the present invention relates to methods and apparatus for handling pipe for the purpose of the installation of a pipe segment into a well pipe. Additionally, the present invention relates to devices for centralizing a pipe segment above the well pipe.

BACKGROUND ART

As used herein, the terms "pipe segments" and "well pipes" can be used to refer severally to drill pipes, drill collars, casings, production tubing, and the like such as may be used in drilling and production operations.

In such operations, lengths of individual downhole tubulars are connected in order to make a string of downhole tubulars necessary for the particular application. The connection of lengths of downhole tubulars to make a string is referred to as "making up" and the disconnection of a string is referred to as "breaking down". The equipment for making up and breaking down a string of downhole tubulars is located on the surface adjacent to the drill hole typically on a drilling floor.

The making up of a string of pipe segments for the purpose of making the well pipe requires the lifting and aligning of an individual length of pipe segment to be added to another pipe segment. Typically, this means that the length of pipe segment to be added is suspended over, aligned and then connected to the well pipe (which may be part of a string of downhole tubulars which may be partially beneath the surface of the earth). The pipe segment to be added may be connected to the well pipe already in place by threading the two of them together either directly or with a coupling. This making up operation necessarily requires that the pipe segment be added must be centered and rotated with respect to the well pipe while the pipe segment is suspended.

Typically, several diameters of pipe segments are used on such an operation. For example, a production tube may be two and seven-eighths inches in diameter, drill pipe may be three to twelve inches in diameter, and casing may be up to thirty-two inches in diameter. As explained above, with respect to each of these different types and different diameters, it is necessary to center the pipe segment and rotate it in order to make up a string. Accordingly, although the centering and rotating may be done by separate devices, it is more efficient if one device could be provided that is able to both center and rotate the pipe segment.

In the past, various patents have issued relating to such spinning apparatus. For example, U.S. Pat. No. 3,799,009, issued on Mar. 26, 1974 to W. Guier, teaches an apparatus for threading and unthreading vertical lengths of drill pipe. This apparatus includes a backup tong removably positioned around a lower drill pipe, a spinner removably positioned around an upper drill pipe, and a lead tong removably positioned around the upper drill pipe. A piston-and-cylinder arrangement is provided so as to pivot several arms so that a clamping operation can occur for the purposes of the backup tong. Another hydraulic cylinder is mounted on a frame so as to actuate several levers so as to place a chain around the exterior of the drill pipe for the purpose of spinning the drill pipe. Unfortunately, this device has no centralization effect and does not reach so as to draw the drill pipe into a central area. This device can only be used on a single diameter of pipe and must be adapted to the various other diameters of pipe which are to be installed in the well.

U.S. Pat. No. 4,005,621, issued on Feb. 1, 1977, to Turner, Jr. et al., teaches a drilling tong having an open head portion and means for adjustably engaging the peripheral portions of workpieces. The drilling tong has an open area into which the drill pipe is inserted. A hydraulic cylinder, mounted on the tong, can actuate several arms and linkages so as to close the clamping elements onto the exterior surface of the pipe. A spring is used to open the jaw. This device lacks a centralizing effect and does not include the mechanism for spinning the pipe. Since the device utilizes teeth on each of the clamping areas, the teeth may actually support the pipe in an undesired position rather than a centralized position.

U.S. Pat. No. 4,446,761, issued on May 8, 1984 to Boyadjieff et al., teaches a pipe spinning tool having two body parts carrying rollers adapted to engage a pipe at different locations around its periphery and to grip and spin the pipe by rotating one or more of the rollers. The two body parts are mounted by pivotal connections for swinging movement about two spaced axes respectively to grip and release the pipe. An adjustable connection attaches the two pivotal connections together for relative lateral adjusting movement to shift their pivotal axes toward and away from one another for gripping different sizes of pipes. This device is a commonly known spinner used in the commercial market. It does not have a centralizing effect. As such, in order to properly center the drilling pipe in a desired location, the frame of the mechanism must be moved backward and forward and the drill pipe must be centered above the well pipe. Additionally, manual efforts are required so as to place the pipe segment between the rollers.

U.S. Pat. No. 5,054,550, issued on Oct. 8, 1991 to L. R. Hodge, teaches a centering spinner for centering and spinning downhole tubulars having a range of diameters. The centering spinner includes a frame capable of admitting a downhole tubular therein and a plurality of roller assemblies pivotally coupled to the frame to converge upon and center the downhole tubular. Adjacent rollers of the roller assemblies of the centering spinner are axially displaced with respect to a downhole tubular retained therein. Although this device is designed for centering, it can only center within a limited area. There is no mechanism for drawing the pipe into the spinning area. If the pipe is too deep within the receiving area, the spinning rollers cannot reach it.

U.S. Pat. No. 5,000,065, issued on Mar. 19, 1991, to C. W. Haynes, describes a jaw assembly for gripping pipes such that the jaws cooperate so as to center the pipe. U.S. Pat. No. 5,778,742, issued on Jul. 14, 1998, to R. L. Stuart, describes a hydraulic backup tong assembly which provides for the gripping of the drill pipe. U.S. Pat. No. 5,791,206, issued on Aug. 11, 1998, to Daigle et al., teaches a wrench for making drill pipe segments. The wrench is arranged so as to center the gripping jaws upon the drill pipe.

It is an object of the present invention to provide a method and apparatus which automatically centers pipe segments of various diameters.

It is another object of the present invention to provide a method and apparatus which allows for the "drawing in" of each of the pipe segments.

It is a further object of the present invention to provide a method and apparatus which requires minimal manual manipulation so as to properly position a pipe segment above the well pipe.

It is a further object of the present invention to provide a method and apparatus which will assure the alignment of the pipe segment with the well pipe without the need for manipulation of the spinner and tong frame.

It is a further object of the present invention to provide a method and apparatus whereby the spinner is automatically centered over the gripping area of the tongs.

It is still another object of the present invention to provide a method an apparatus which minimizes the risk of injury and maximizes installation efficiency at the worksite.

It is still a further object of the present invention to provide an apparatus which is relatively inexpensive, easy to use and easy to manufacture.

These and other objects and advantages of the present invention will become apparent from a reading of the attached specification and appended claims.

SUMMARY OF THE INVENTION

The present invention is an apparatus for installing a pipe segment in a well pipe comprising a frame having a reach area formed therein, a first arm pivotally connected to the frame, a first roller rotatably mounted on the first arm, a second arm pivotally connected to the frame, a second roller rotatably mounted on the second arm, a third arm pivotally connected to the frame, a third roller rotatably mounted onto the third arm, and an actuator linked to at least one of the arms and adapted to pivot of the arms such that the respective rollers on the arms move into the reach area. The second arm is linked to the first arm so as to cause the second roller to move toward the reach area as the first roller moves into the reach area. Similarly, the third arm is linked to the second arm such that the movement of the second roller toward the reach area causes the third roller to move toward the reach area.

The actuator is adapted to move the arms such that the rollers contact a surface of the pipe segment in the reach area with a longitudinal axis of the pipe segment radially spaced equally from the axes of rotation of each of the rollers. Each of the rollers has an equal diameter.

In the present invention, each of the arms are linked together such that the arms move concomitantly with the other arms upon an actuation by the actuator. The rollers are adapted to position the well pipe within the reach area such that a longitudinal axis of the well pipe is located at an identical location within the reach area regardless of a diameter of the well pipe.

In the present invention, the first arm includes a claw member which extends outwardly from a side of the first roller opposite the point of pivotal connection of the first arm with the frame. The claw extends outwardly beyond a diameter of the first roller. Similarly, the second arm has a claw member extending outwardly from a side of the second roller opposite the point of pivotal connection of the second arm with the frame. The third arm also includes a claw member extending outwardly from a side of the third roller opposite the point of pivotal connection of the third arm with the frame.

The linkage mechanism of the present invention facilitates the operation of the present invention. The first arm has a lever connected to the actuator and a link arm connected to the linkage extending to the second arm. The lever and the link arm extend outwardly from the first arm on a side of the point of pivotal connection of the first arm with the frame opposite the first roller. The linkage extending to the second arm includes a link member pivotally connected to the link arm of the first arm and a pull rod arm having one end pivotally connected to an end of the link member opposite the link arm. The pull rod arm has an opposite end pivotally connected to the second arm at an end of the second arm opposite the second roller. The second arm includes a lever mounted to the opposite end of the pull rod arm. The second arm has a link arm connected by a synchronization lever to the third arm. The lever and the link arm of the second arm extend from a side of the point of pivotal connection of the second arm opposite the second roller. The third arm has a pull rod lever extending outwardly from a side of a point of pivotal connection of the third arm with the frame opposite the third roller. The synchronization lever is pivotally connected to the pull rod lever of the third arm.

In the present invention, the actuator is a hydraulic cylinder with a piston rod extending outwardly therefrom. The hydraulic cylinder has an end pivotally connected to the frame. The piston rod has an end pivotally connected to the first arm.

In the present invention, the frame is affixed to a vertical shaft such that the frame extends outwardly transverse to the vertical shaft. The frame is movable along the shaft during an installation of the well pipe. The vertical shaft is supported upon a displaceable base. The vertical shaft has a torque wrench extending outwardly therefrom below the frame. The torque wrench includes a grip area which is in longitudinal alignment with a center of the area between the respective rollers when the pipe segment is gripped therebetween.

The present invention is also a method of installing a pipe segment into the end of a well pipe comprising the steps of: (1) suspending the pipe segment such that a longitudinal axis of the pipe segment is vertically oriented; (2) positioning the suspended pipe segment into a reach area of a spinner; (3) actuating the spinner such that the claw member draws the pipe segment into the frame such that the longitudinal axis of the pipe segment is aligned with a longitudinal axis of the well pipe; and (4) rotating the pipe segment by the spinner such that an end of the pipe segment is threadedly received within an end of the well pipe.

The present invention, in an alternative embodiment, is a centralizer, without rollers, for positioning the pipe segment in a desired position.

DETAILED DESCRIPTION OF THE PRESENT INVENTION

Figure 1:
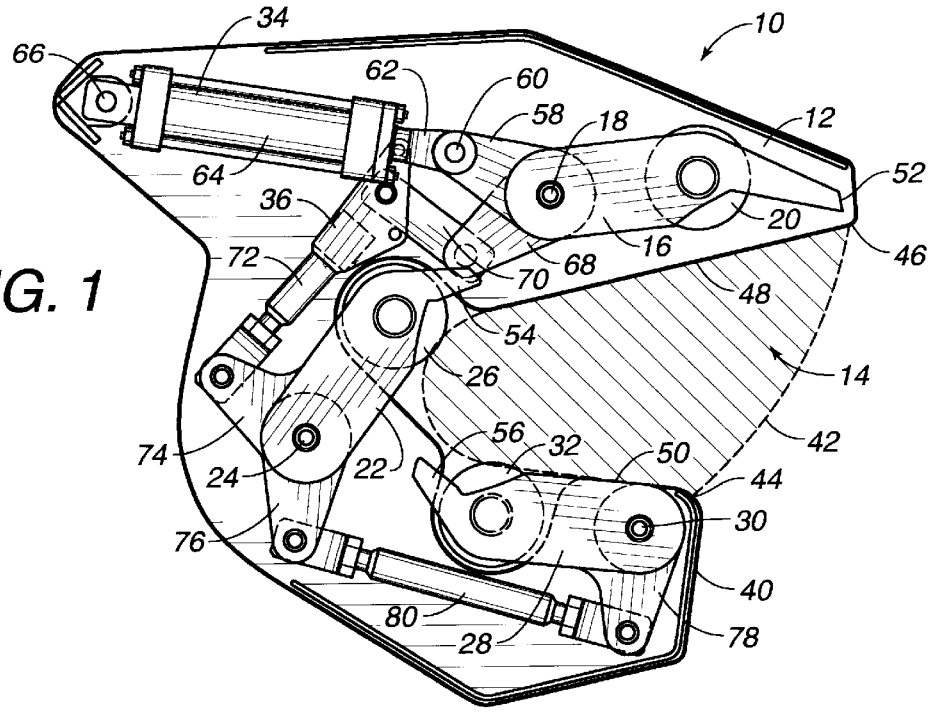
FIG. 1 is a plan view of the apparatus of the present invention as shown in an open position.

Referring to FIG. 1, there is shown at 10 the spinner apparatus in accordance with the preferred embodiment of the present invention. The spinner apparatus 10 includes a frame 12 having a reach area 14 formed therein. A first arm 16 is pivotally connected at 18 to the frame 12. A first roller 20 is rotatably connected to the first arm 16. A second arm 22 is pivotally connected at 24 to the frame 12. A second roller 26 is rotatably connected to the second arm 22. A third arm 28 is pivotally connected to the frame 12 at pivot point 30. A third roller 32 is rotatably connected to the third arm 28. An actuator 34 is linked to the first arm 16. The first arm 16 is connected by linkage 36 to the second arm 22. Similarly, the second arm 22 is connected by synchronization linkage 38 to the third arm 28. The actuator 34 is adapted to pivot the first arm 16 such that the roller 20 will move toward the reach area 14. At the same time, the linkages 36 and 38 will cause the roller 26 on the second arm 22 and the roller 32 on the third arm 28 to move in a coordinated manner toward the reach area 14.

The reach area 14 is generally a U-shaped indentation which extends inwardly from the outer edge 40 of the frame 12. The outer limit 42 of the reach area 14 will actually extend outwardly of the opening formed between the corner 44 and the corner 46 of the frame 12. In FIG. 1, the cross-hatched area is indicative of the reach area 14. This cross-hatched extends entirely between the walls 48 and 50 of the indentation of the frame 12 and beyond the outer edge 14 of the frame 12. This reach area 14 is indicative of the "reach" of the arms of the spinner apparatus 10 of the present invention for the receipt of a pipe segment therein. The walls 48 and 50 have a "funnel" shape so as to urge the pipe segment to its desired centralized position.

In FIG. 1, it can be seen that the first arm 16 includes a claw member 52 which extends outwardly from a side of the first roller 20 opposite the pivot point 18. It can be seen that the claw 52 extends outwardly beyond the outer diameter of the first roller 20. The claw member 52 will serve to draw a pipe segment into the interior of the reach area 14 within the frame 12. The second arm 22 includes a claw member 54 which extends outwardly from a side of the second roller 26 opposite the pivot point 24. This claw member 54 will cause the pipe segment to move toward its desired position within the reach area 14. Additionally, the third arm 28 includes a claw member 56 which extends outwardly beyond an outer diameter of the third roller 32 on a side opposite the pivot point 30. The claw members 52, 54 and 56 will interact so as to place the pipe segment into its desired centralized position and to place the pipe segment between the outer surfaces of the rollers 20, 26 and 32 (as will be described hereinafter).

The first arm 16 has a lever 58 which is pivotally connected at 60 to the piston 62 associated with the hydraulic cylinder 64 of the actuator 34. The hydraulic cylinder 64 is pivotally connected at 66 to the frame 12. The first arm 16 also has a link arm 68 connected to the linkage 36 to the second arm 22. The lever 58 and the link arm 68 extend outwardly from the first arm 16 on a side of the point of pivotal connection 18 of the first arm 16 with the frame 12.

The linkage 36 includes a link member 70 which is pivotally connected to the link arm 68 of the first arm 16. The linkage 36 also includes a pull rod arm 72 which is pivotally connected to an end of the link member 70 opposite the link arm 68. The pull rod arm 72 has an opposite end pivotally connected to the second arm 22 at an end of the second arm 22 opposite the second roller 26.

The second arm 22 has a lever 74 connected to the end of the pull rod arm 72 opposite the link member 70. The second arm 22 also has a link arm 76 which is connected by synchronization linkage 38 to the third arm 28. The lever 74 and the link arm 76 of the second arm 22 extend from a side of the point of pivotal connection 24 of the second arm 22 opposite the roller 26.

The third arm 28 includes a pull rod lever 78 extending outwardly from a side of the point of pivotal connection 30 of the third arm 28 with the frame 12 opposite the third roller 32. The pull rod lever 78 is connected to one end of the synchronization linkage 38. The synchronization linkage 38 includes a synchronization lever 80 having one end pivotally connected to the pull rod lever 78 of the third arm 28 and an opposite end pivotally connected to the link arm 76 of the second arm 22.

Figure 2:
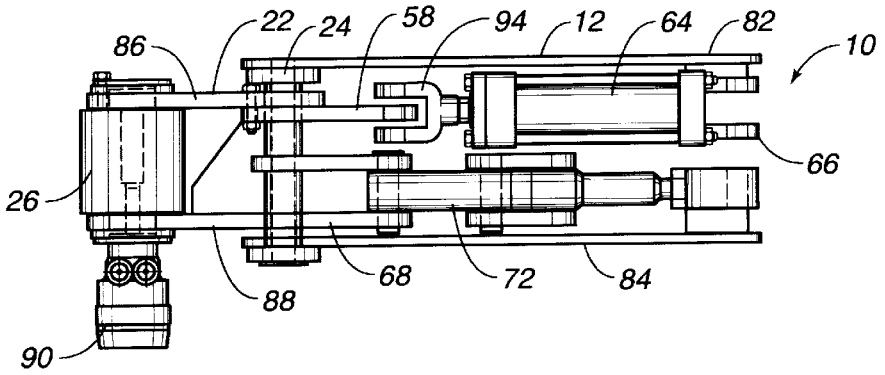
FIG. 2 is a side view of one side of the apparatus of the present invention.

FIG. 2 shows a side view of the arrangement of the spinner apparatus 10. As can be seen, the frame 12 includes a top side 82 and a bottom side 84. As can be seen, the pivot 24 is pivotally received between the top side 82 and the bottom side 84. The second arm 22 is illustrated as having a top component 86 and a bottom component 88. The top component 86 and the bottom component 88 serve to receive the roller 26 therebetween. A hydraulic motor 90 is connected to the roller 26 so as to drivingly rotate the roller 26 in a desired direction.

It is important to note that the spinner apparatus 10 can operate either as a centering device or as a spinner. If the device is used solely as a centering device, then there is no need for the hydraulic motor 90. Alternatively, if used solely as a centering device, the rollers 20, 26 and 32 can be removed (in the manner shown in FIGS. 14–16). On the other hand, when the device 10 is used as a spinner apparatus, the motor 90 will drivingly rotate the roller 26 so as to rotate the pipe segment contacting the roller 26. It is possible for separate hydraulic motors to be connected to each of the rollers 20, 26 and 32. Also, it is possible to use two hydromotors or airmotors with each roller. The use of two of such motors will eliminate the need for bearings and simplifies maintenance and repair. However, and alternatively, a single motor 90 can be used with any one of the rollers 20, 26 and 32 while the remaining rollers simply act as idler rollers. The motor 90 can be a hydromotor. The shaft 92 of the motor 90 is directly connected to the roller 26. The roller 26 can be suitably mounted in proper bearings associated with the components 86 and 88 of the arm 22.

FIG. 2 also shows the cylinder lever 58 as connected to the hydraulic cylinder 64 by way of a clevis pin 94. The hydraulic cylinder 64 is illustrated as being pivotally connected to the upper frame component 82 at pivot point 66. The link arm 68 is illustrated as receiving the pull rod arm 72.

Figure 3:
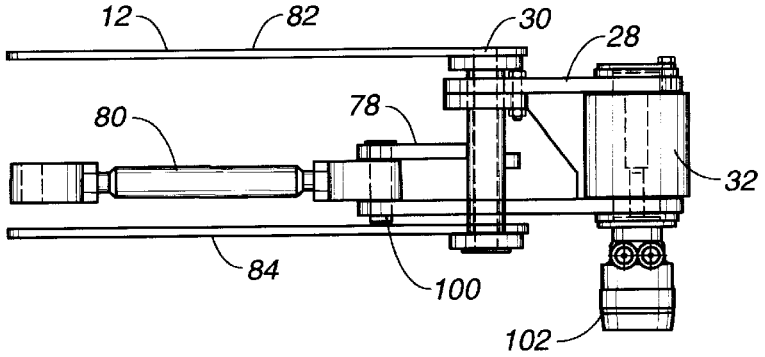
FIG. 3 is a side view showing another side of the apparatus of the present invention.

FIG. 3 shows another side of the frame 12 of the present invention. In FIG. 3, it can be seen that the synchronization arm 80 has one end 100 pivotally connected to the pull rod lever 78 associated with the third arm 28. A pivot mount 30 serves to rotatably connect the third arm 28 to the frame 12. Roller 32 is illustrated as being drivingly connected to a motor 102. It is to be noted that various types of motors 102, such as a direct drive or a gear and train transmission drive, can be utilized for the rotation of the roller 32.

Figure 4:
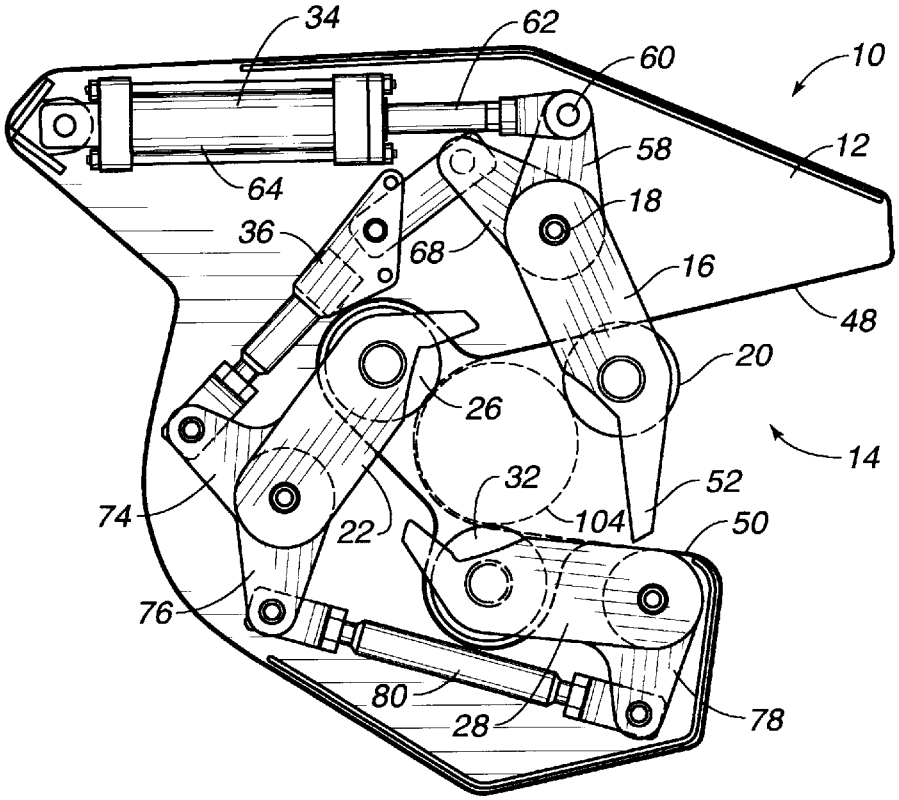
FIG. 4 is a plan view showing the operation of the present invention as gripping a large diameter pipe within the reach area.
Figure 5:
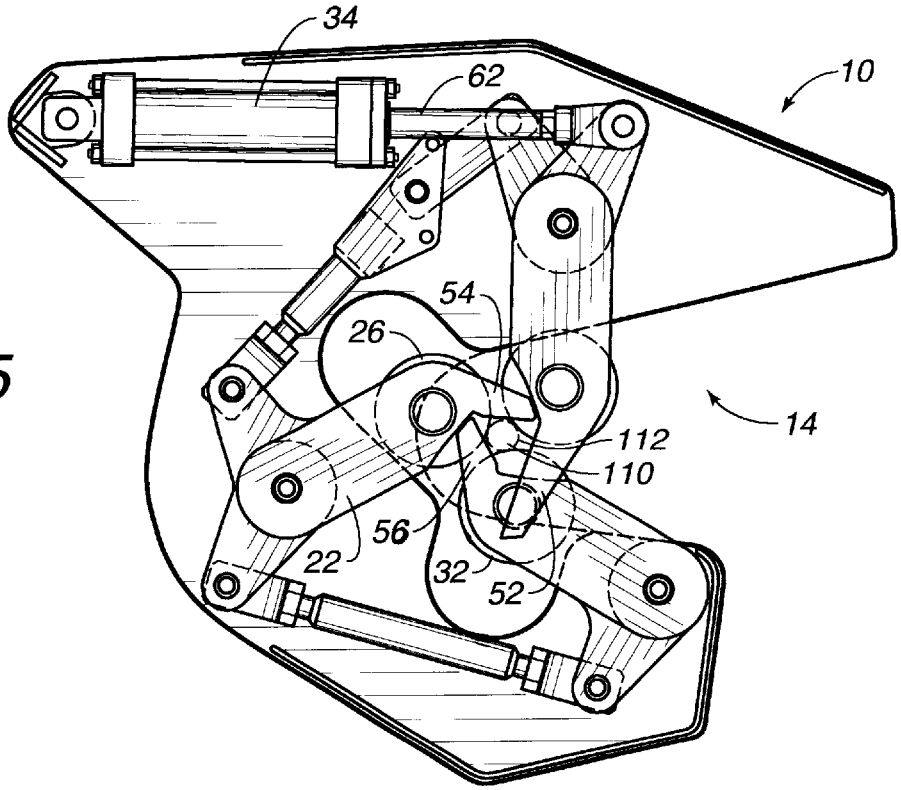
FIG. 5 is a plan view of the present invention showing the receipt of a small diameter pipe within the reach area.

FIGS. 4 and 5 illustrate the manner in which the spinner apparatus 10 of the present invention can be used for the centering of pipe segments of different diameters. Importantly, it is to be noted that in the present invention, the spinner apparatus 10 serves to position the pipe segment such that the longitudinal axis of the pipe segment will always be in the identical position within the reach area 14. As such, the pipe segments will always be in longitudinal alignment with the well pipe during the installation procedures.

In FIG. 4, it can be seen that the drill pipe 104 has been positioned within the reach area 14 of the frame 12. The pipe segment 104 is drawn into its desired position within the interior of the reach area 14 between the walls 48 and 50 of the frame 12 by the manipulation of the claw member 52 at the end of the first arm 16. The tip of the claw member 52 will contact a surface of the pipe segment 104 and pull the pipe segment into the reach area 14 and into the opening of the frame 12. In FIG. 4, a relatively large diameter pipe 104 is illustrated. It can be seen that the outer surface of the pipe segment 104 contacts the surfaces of rollers 20, 26 and 32. In this position, the central axis of each of the rollers 20, 26 and 32 will be equally spaced from the central longitudinal axis of the pipe segment 104. Each of the rollers 20, 26 and 32 will be spaced equally with respect to each other.

So as to carry out the operation of centralizing the pipe segment 104, the hydraulic cylinder 64 of actuator 34 is actuated so as to cause the piston rod 62 to move outwardly. This causes a pivoting of the lever 58 about pivot point 60. Simultaneously, the arm 16 will pivot about pivot point 18 so as to cause the roller 20 and the claw member 52 to move into the interior of the reach area 14 while pushing the pipe segment 104. Additionally, the link arm 68 will pivot the linkage 36 so as to cause the lever 74 of the second arm 22 to move the roller 26 outwardly so as to contact a surface of the pipe segment 104. Also, and simultaneously, the link arm 76 of the second arm 22 will pull the synchronization lever 80 so as to draw the pull rod lever 78 in a direction such that the third arm 28 will pivot such that the roller 32 contacts the surface of the pipe segment 104. All of this movement occurs coordinatedly with the movement of the actuator 34.

FIG. 5 illustrates how a small diameter drill pipe 110 can be received so that it is in an identical position within the reach area 14. As can be seen, the piston arm 62 of the actuator 34 extends outwardly further than in FIG. 4. The pipe segment 110 will move inwardly into the reach area 14 by moving along the linear edge of the first claw member 52. Similarly, the claw member 54 of the second arm 22 will move the small diameter pipe segment 110 toward its desired position against the second roller 26. Also, and simultaneously, the third claw member 56 will urge the small diameter pipe segment 110 into its desired position against the third roller 32. The various linkages between the respective arms will assure that the small diameter pipe segment 110 will reside so that the longitudinal axis of the pipe segment 110 will reside within the identical position within the reach area 14 as would the large diameter pipe section 104 (as shown in FIG. 4). The various claw members serve to transport the small diameter pipe section 110 to the interior of the reach area 14 and to position the pipe segment 112 against the surfaces of the respective rollers.

Figure 6A:
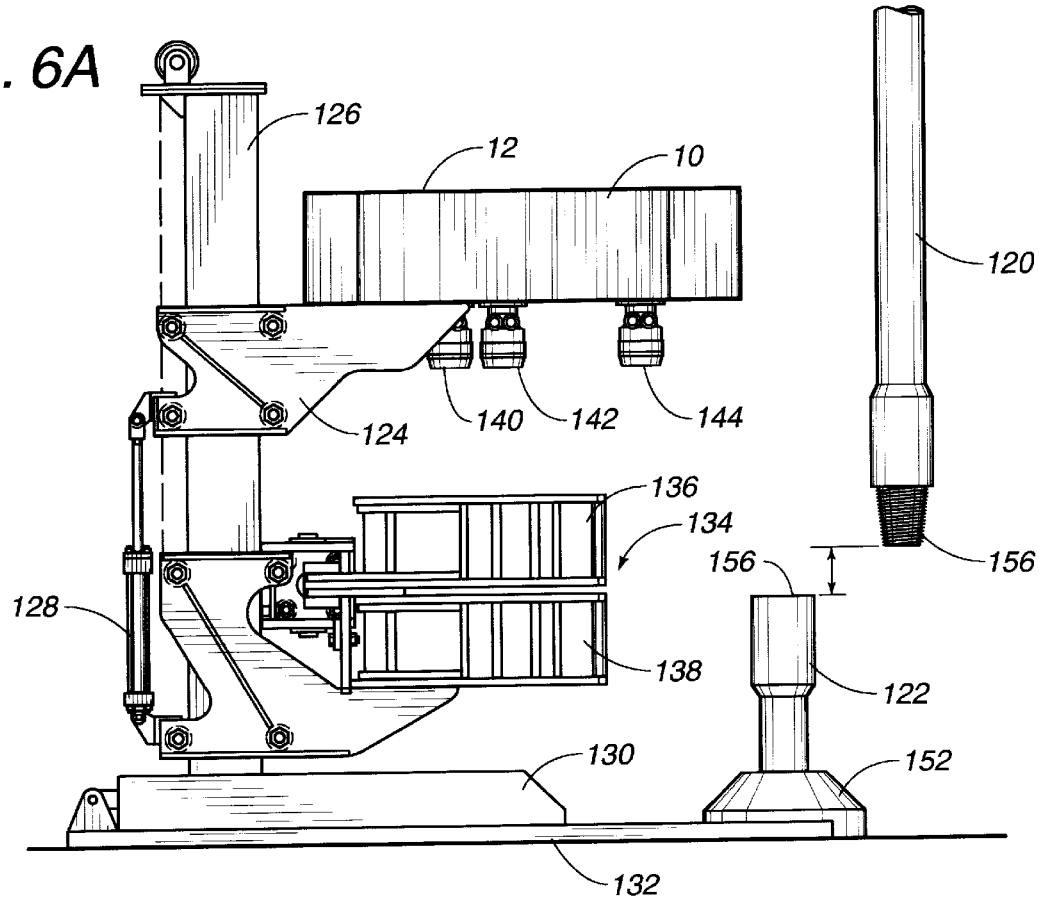
FIGS. 6A and B are side and plan views, respectively, of the first step of the method of the present invention for the installation of the pipe segment.

FIGS. 6A and B show how the spinner apparatus of the present invention can be used for the installation of a pipe segment 120 into a well pipe 122. In FIG. 6A, it can be seen that the frame 12 of the spinner apparatus 10 is affixed to a support 124 which is affixed along a vertical column 126. A hydraulic actuator 128 is connected to the support 124 so as to move the frame 12 upwardly and downwardly with respect to the vertical column 126. It can be seen that the frame 12 is affixed to the support 124 so as to be oriented transverse to the vertical column 126 in a generally horizontal plane. The vertical column 126 extends upwardly from a translatable base 130. The base 130 can be suitably moved forward and backward along the floor 132 with respect to the well pipe 122. A torque wrench 134 is also affixed to the vertical column 126 and extends outwardly therefrom below the spinner apparatus 10. The torque wrench 134 has an upper clamp 136 and a lower clamp 138. These clamps have an interior grip area which will be aligned with the center of the spinner apparatus 10.

In FIG. 6A, it can be seen that three motors 140, 142 and 144 extend downwardly below the bottom of the spinner apparatus 10. These motors 140, 142 and 144 serve to drive the respective rollers on the interior of the spinner apparatus 10.

Figure 6B:
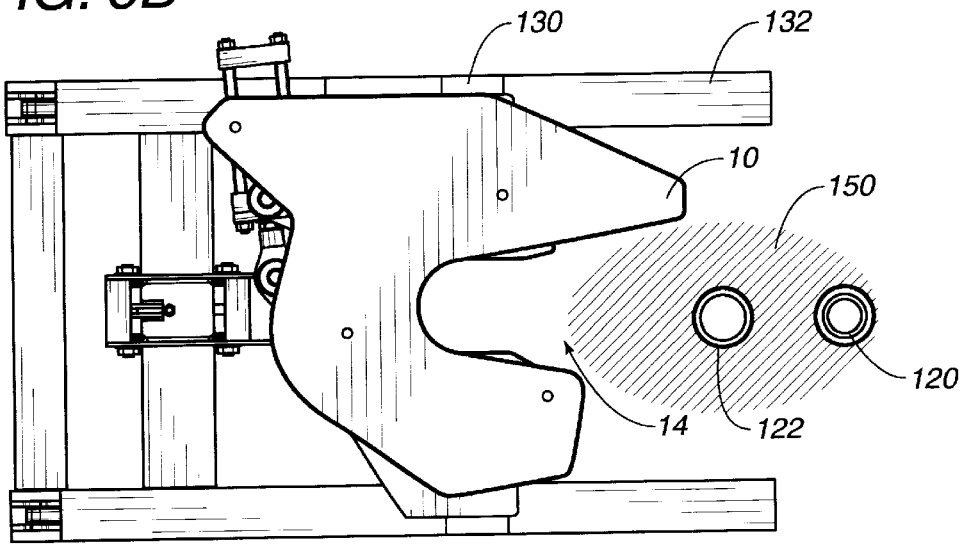

In FIG. 6B, it can be seen that the drill pipe 120 is suspended above the well pipe 122. The spinner apparatus 10 is shown in its retracted position and having reach area 14 therein. The cross-hatched area 150 in FIG. 2 will illustrate the position of the reach area 14 of the spinner apparatus 10 when the spinner apparatus 10 is moved forward along the floor 132 upon the translatable base 130.

With respect to FIGS. 6A and 6B, the pipe segment 120 is positioned over the top of the drill string which is suspended on a slip 152. The pipe segment 120 is suspended with an elevator on a wire. In order to install the pipe segment 120 on the well pipe 122, it will be necessary to move the pipe segment 120 so as to be in generally longitudinal alignment with the well pipe 122 and such that the threaded portion 156 will stab into the interior of the mating threads 158 of the well pipe 122.

Figure 7A:
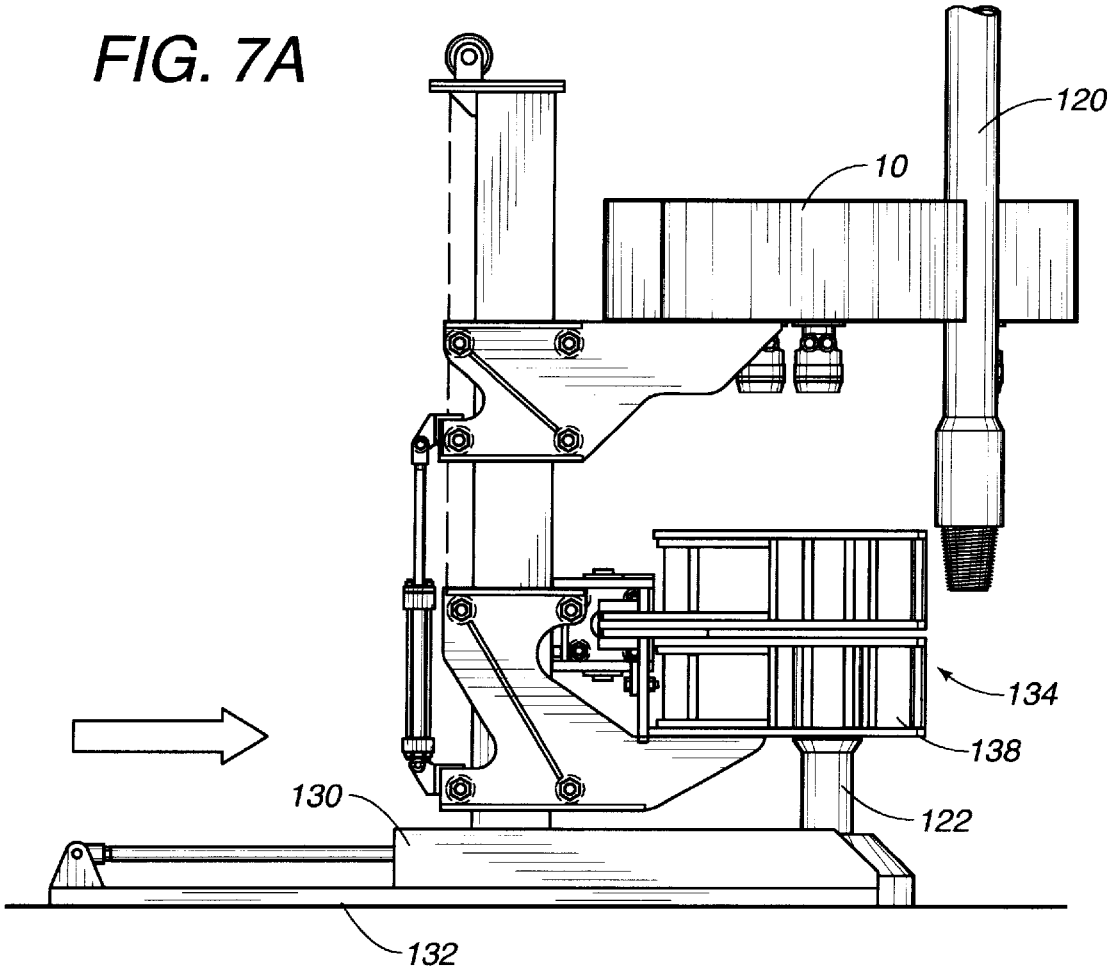
FIGS. 7A and B are side and plan views of the second step of the method of the present invention for the installation of the pipe segment.
Figure 7B:
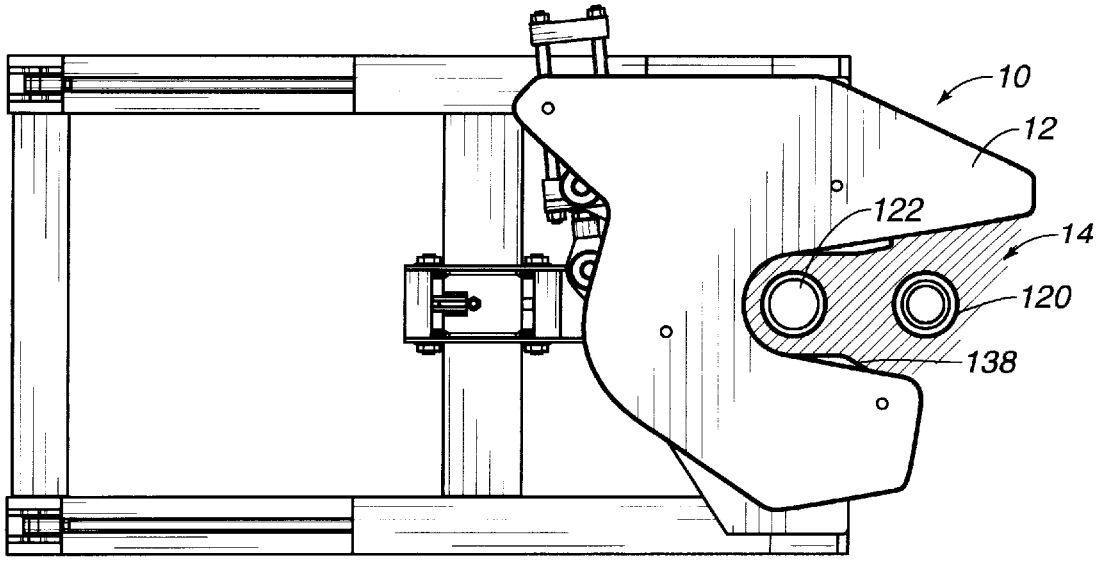

In FIG. 7A, the spinner apparatus 10 has been moved forward on the translatable base 130 upon the floor 132. As such, the pipe segment 120 has been positioned within the reach area 14 of the frame 12 of the spinner apparatus 10. The torque wrench 134 has been positioned so that the bottom clamp 138 is positioned around the well pipe 122. In FIG. 7B, it can be seen that the pipe segment 120 is in a position within the reach area 14 of the frame 12 of the spinner apparatus 10. The well pipe 122 is positioned within the gripping area of the bottom clamp 138. It can be seen in FIG. 7B that both the pipe segment 120 and the well pipe 122 are located within the reach area 14.

Figure 8A:
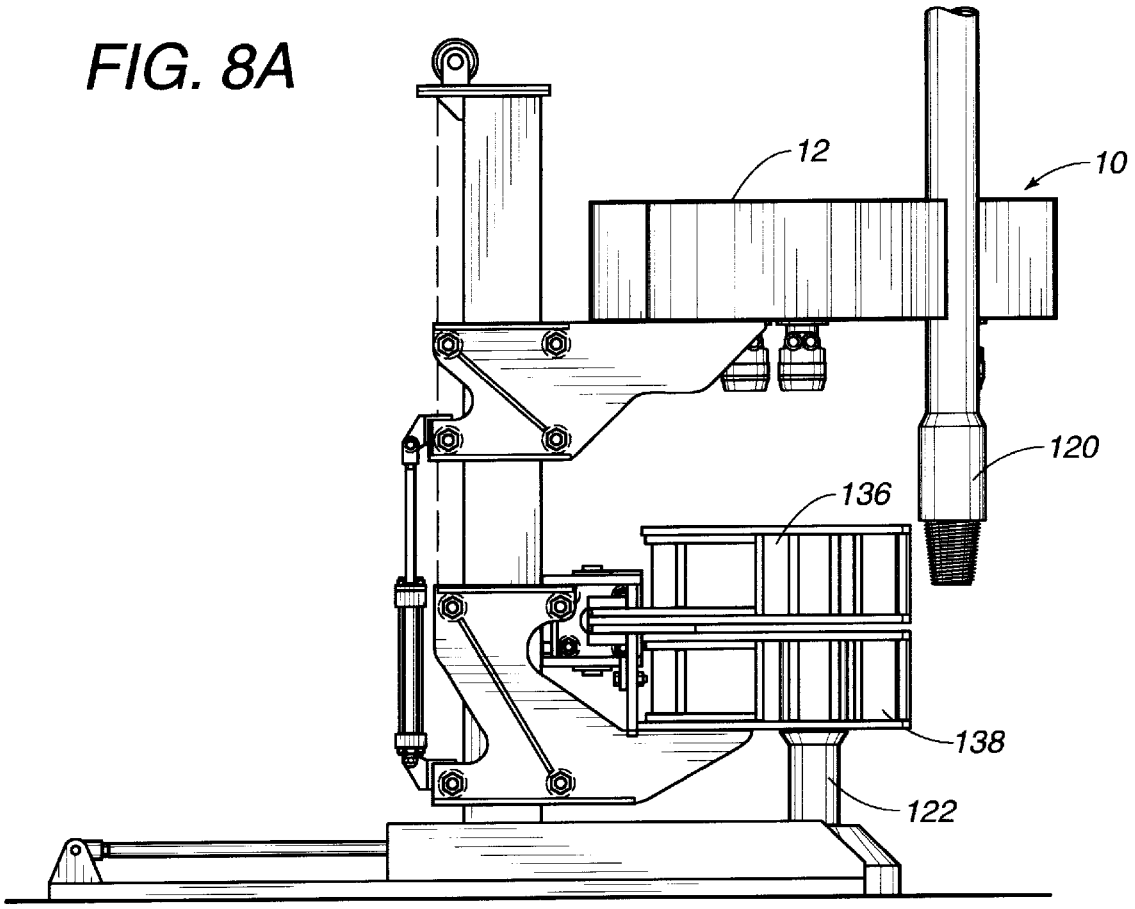
FIGS. 8A and B are side and plan views showing the receipt of the pipe segment within the spinner apparatus in accordance with the method of the present invention.
Figure 8B:
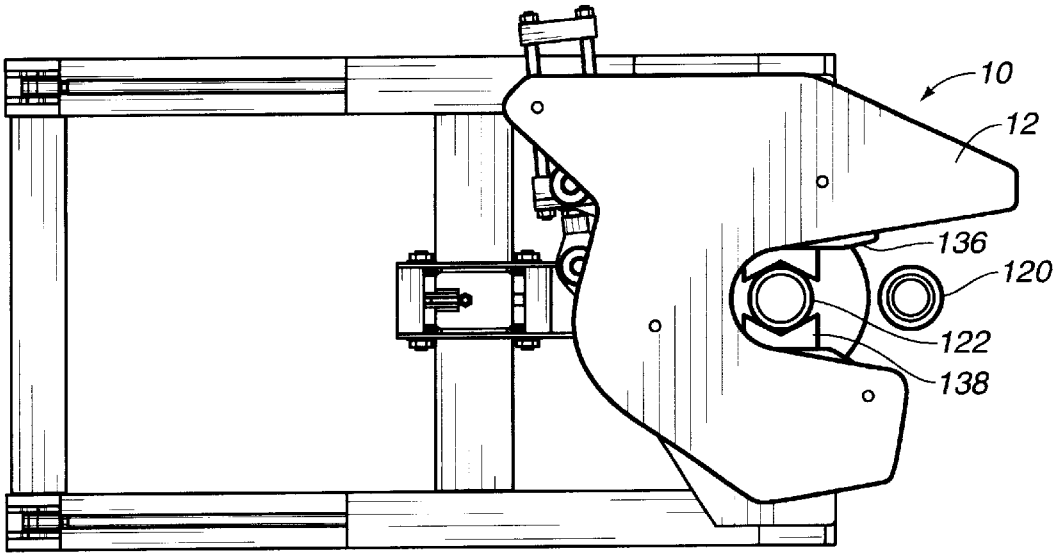

In FIGS. 8A and 8B, the bottom clamp 138 is illustrated as clamping the top of the well pipe 122. The upper clamp 136 will remain open.

Figure 9A:
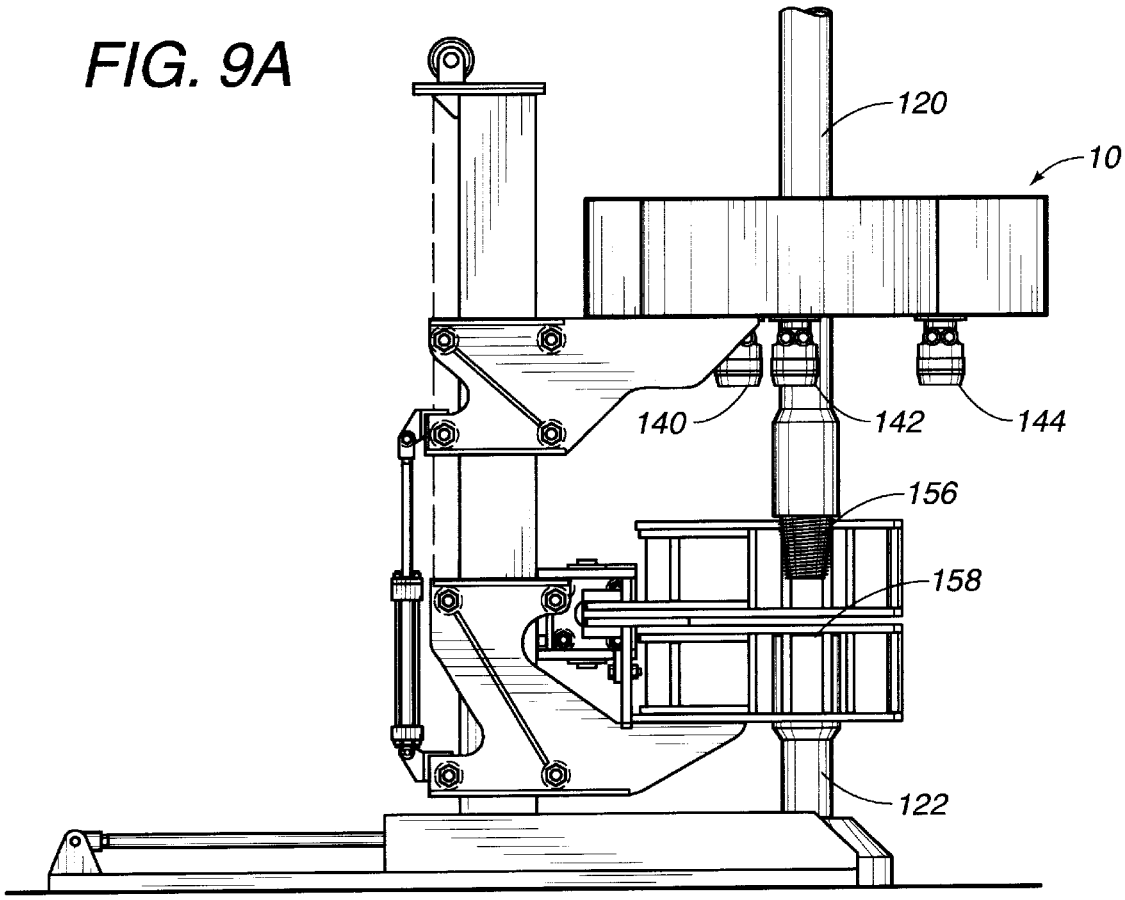
FIGS. 9A and B are side and plan views showing the centering of the pipe segment over the well pipe by the use of the method of the present invention.
Figure 9B:
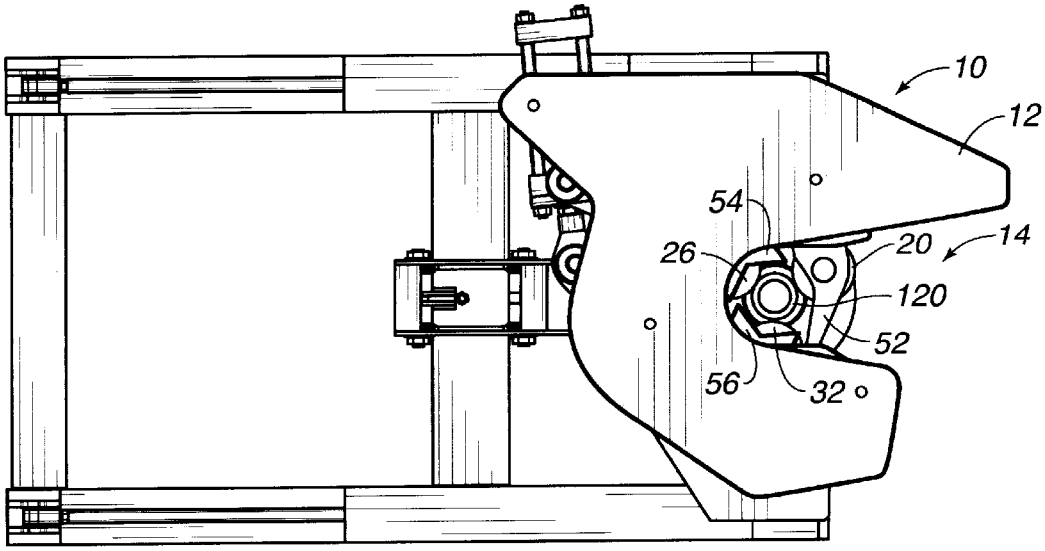

In FIGS. 9A and 9B, the present invention is illustrated as positioning the pipe segment 120 in its desired centralized position above the top of the well pipe 122. This is accomplished by the actuation of the actuator 34 within the spinner apparatus 10. As can be seen in FIG. 9B, the claw members 52, 54 and 56 will serve to centralize the pipe segment 120 within the reach area 14 of the frame 12 of the spinner apparatus 10. As was described previously, this operation will centralize the pipe segment 120 so that the threaded section 156 of the pipe segment 120 will be directly and centrally located above the receiving threaded area 158 of the well pipe 122. The pipe segment 120 will also be in rotatable frictional contact with each of the rollers 20, 26 and 32. The motors 140, 142 and 144 will then begin to rotate so that the rollers 20, 26 and 32 will cause the pipe segment 120 to start rotating.

Figure 10A:
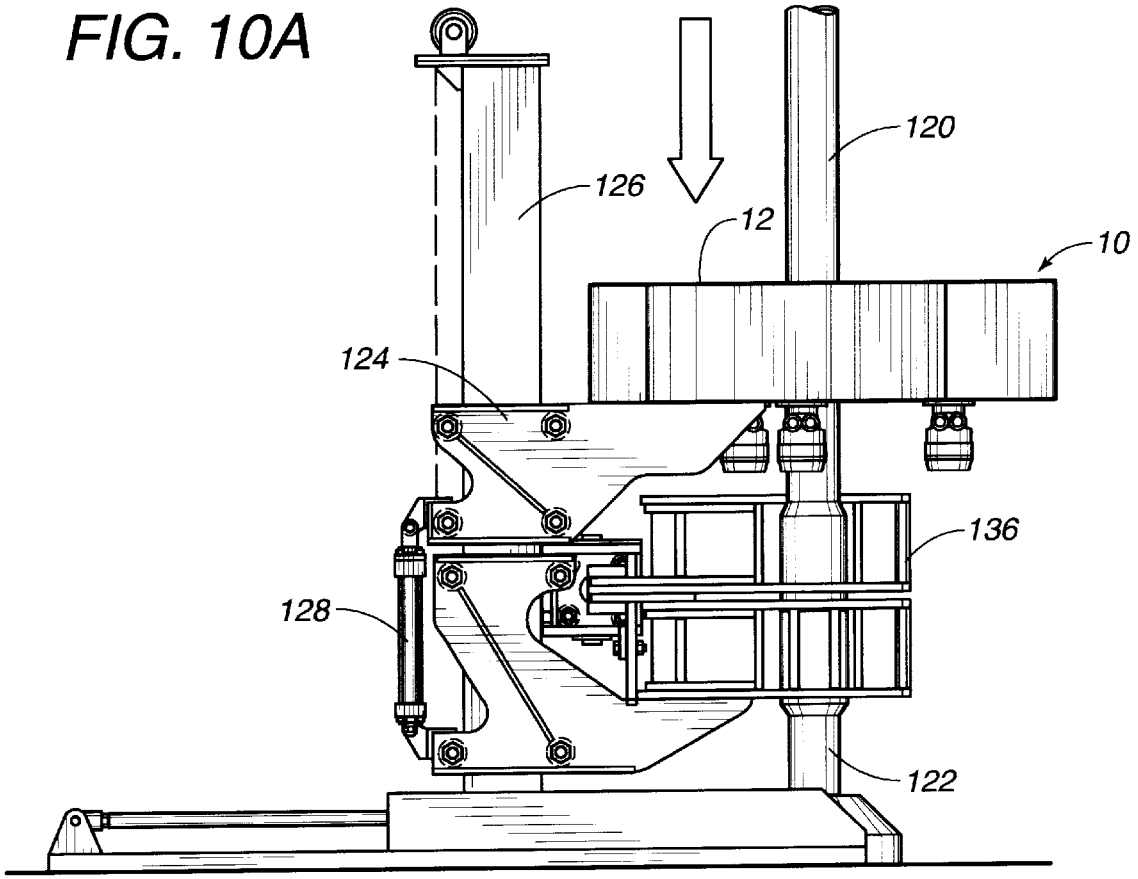
FIGS. 10A and B are side and plan views showing the rotation of the pipe segment into the well pipe in accordance with the method of the present invention.
Figure 10B:
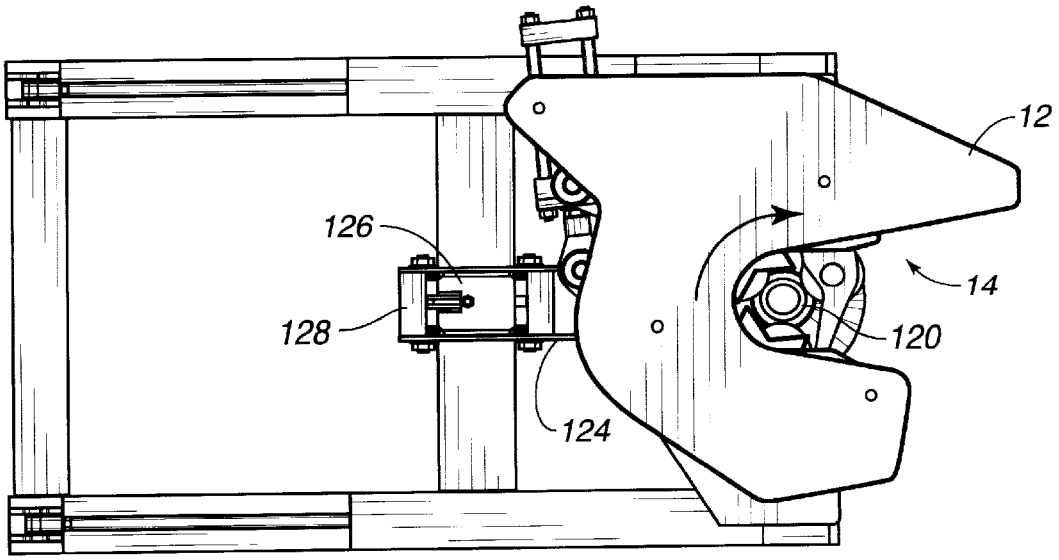

FIGS. 10A and 10B show the installation of the pipe segment 120 within the well pipe 122. In this arrangement, the spinner apparatus 10 will be continually rotating the pipe segment 120 in a desired direction. The frame 12 as attached to the support 124 will be lowered along the vertical shaft 126 as illustrated by the direction of the arrow in FIG. 10A. This will cause the threaded end 156 to engage the threads 158 of the well pipe 122. The lifting cylinder 128 assures that the pipe segment 120 is received within the well pipe 122 with a smooth stabbing action and connection. The cylinder 128 will act as a shock absorber so as to avoid any possible damage between the connection of the threads. The pipe segment 120 will continue to rotate until a connection is established between the respective threaded sections of the sections of pipe. After this connection has been established, the top clamp 136 can be used to apply torque to the pipe segment 120.

Figure 11A:
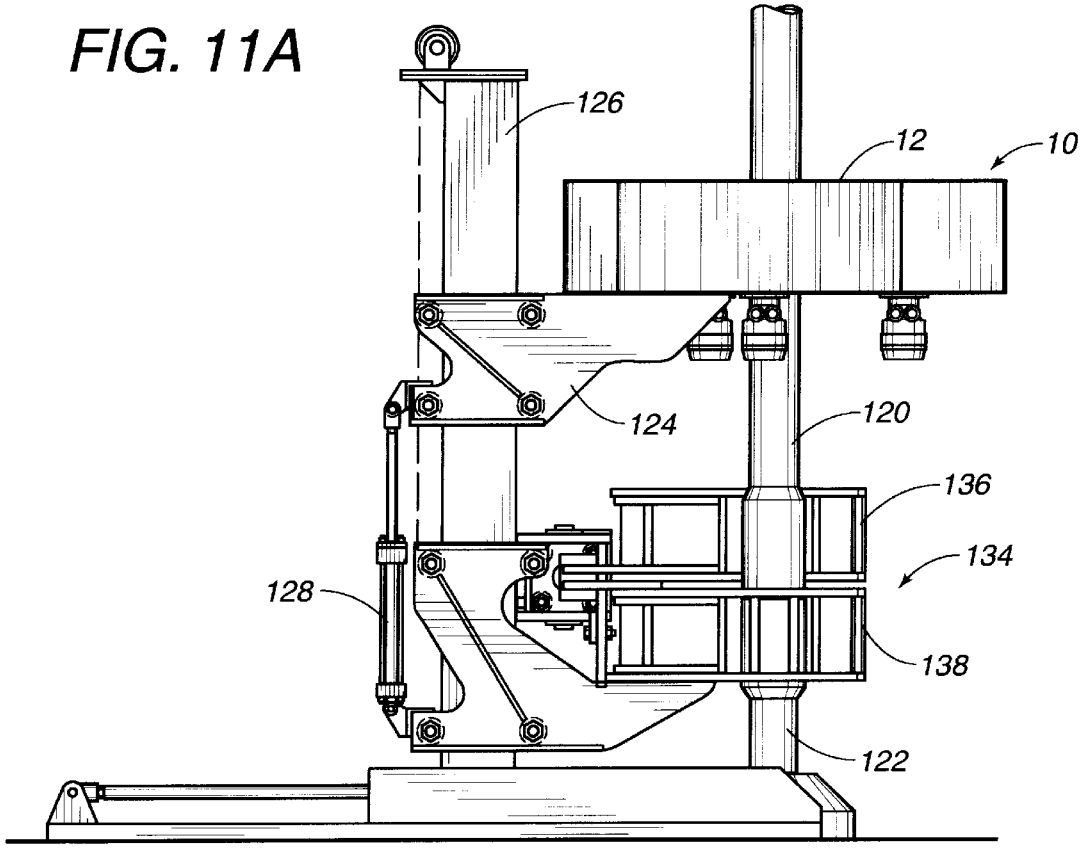
FIGS. 11A and B are side and top views showing the locking of the pipe segment within the well pipe using the method and apparatus of the present invention.
Figure 11B:
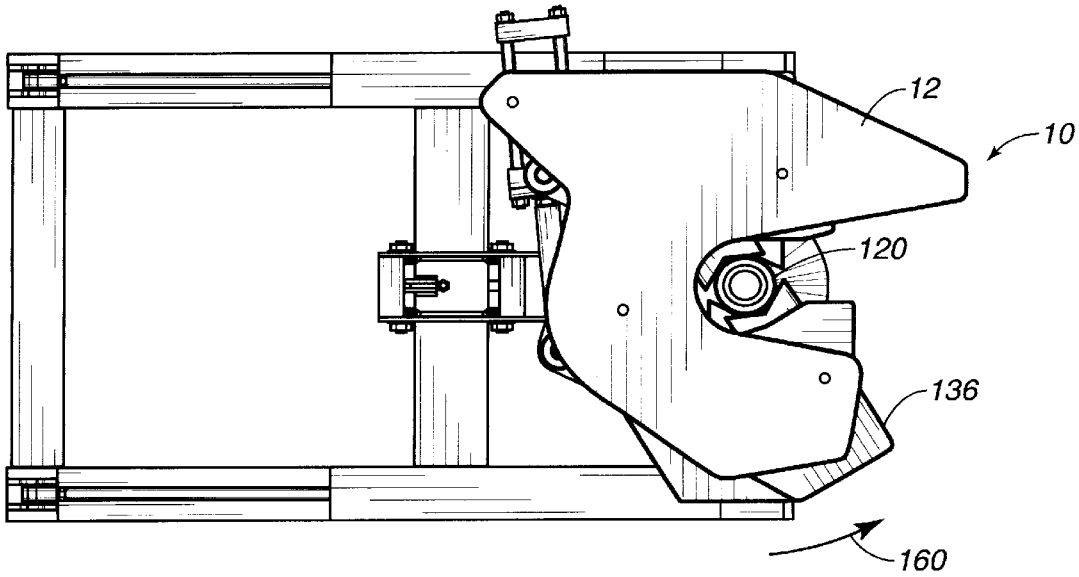

FIGS. 11A and 11B show how the pipe segment 120 is joined to the well pipe 122 in a secure and tight manner. After the spinning operation has been completed, the operator will actuate the cylinder 128 so as to move the support 124 upwardly along the vertical column 126 such that the frame 12 of the spinner apparatus 10 is lifted from the pipe segment 120. Additionally, and simultaneously, the hydraulic actuator 34 within the spinner apparatus 10 can be moved so as to release the rollers from the exterior surface of the pipe segment 120. This will allow the spinner apparatus 10 to freely separate from the pipe segment 120. Since the torque wrench 134 is securely mounted such that the upper clamp 136 is secured to the pipe segment 120 and the lower clamp 138 is secured to the well pipe 122, the torque wrench 134 is now in a position for tightening the pipes together. The top clamp 136 can be rotated in the direction of arrow 160 to a position suitable for making up the connection between the pipe segment 120 and the well pipe 122.

Figure 12A:
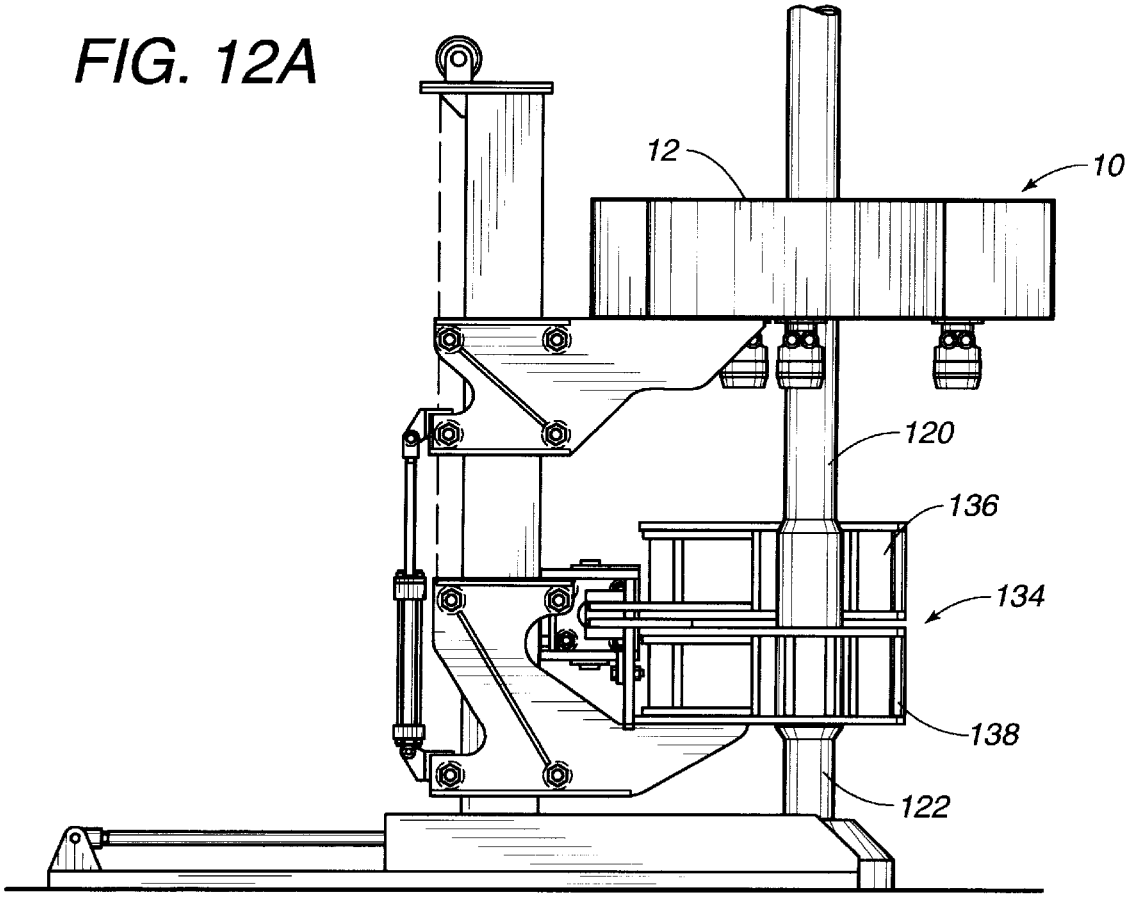
FIGS. 12A and B are side and plan views further showing the locking of the pipe segment into the well pipe in accordance with the method of the present invention.
Figure 12B:
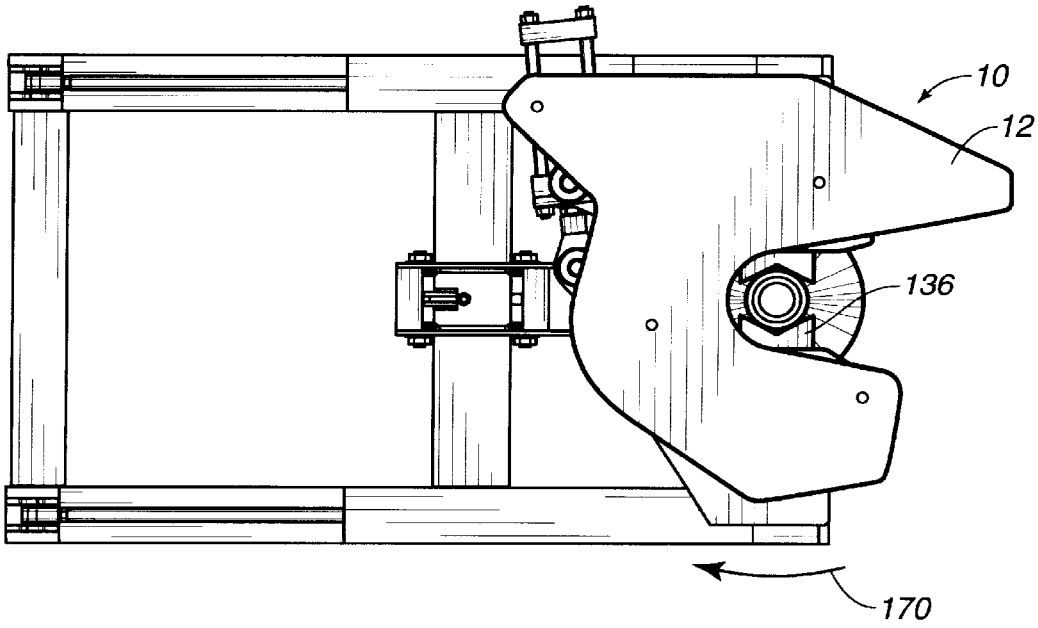

FIGS. 12A and 12B show that the top clamp 136 is rotated in the direction of arrow 170 with respect to the bottom clamp 138 of torque wrench 134. This causes the connection between the pipe segment 120 and the well pipe 122 to receive the desired torque.

Figure 13A:
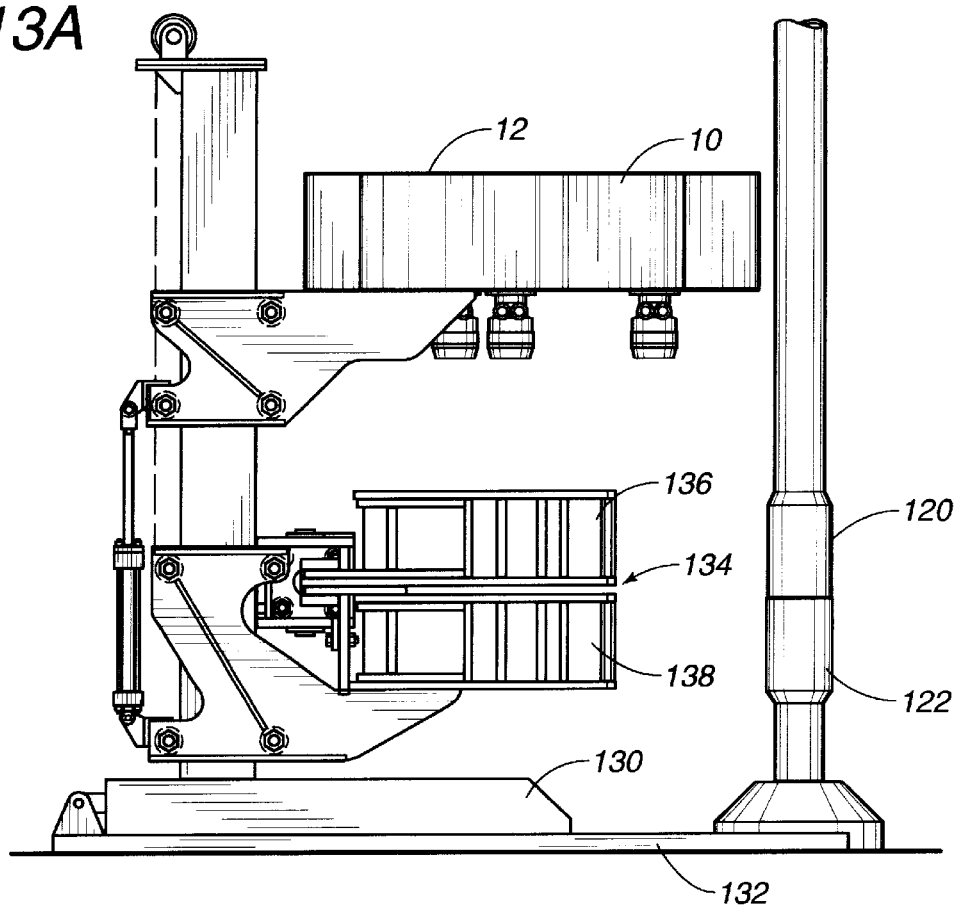
FIGS. 13A and B are side and plan views showing the release of the assembled pipe string in accordance with the method of the present invention.
Figure 13B:
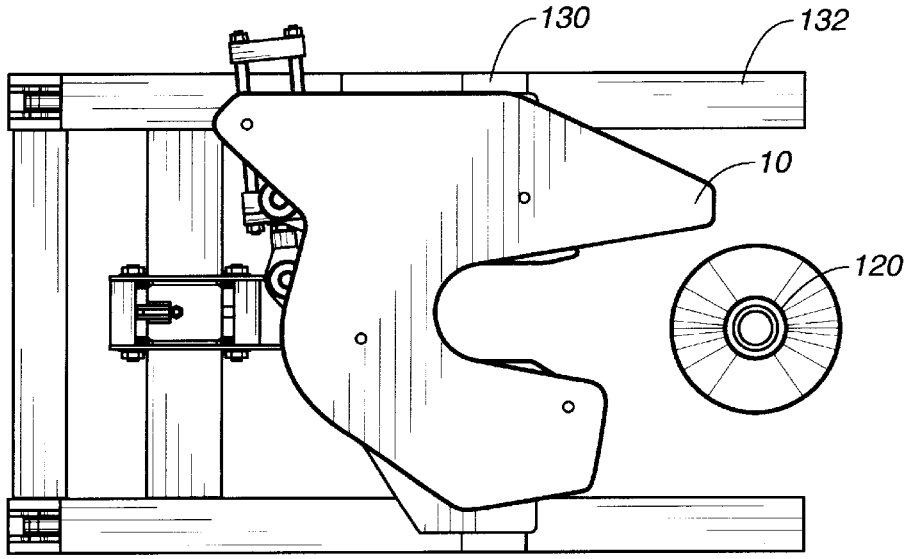

FIGS. 13A and 13B show the final step for the method of the present invention. As can be seen, the top clamp 136 and the bottom clamp 138 are released from the pipe segment 120 and the well pipe 122, respectively. The translatable base 130 is then moved away from the well pipe 122 along floor 132. Similarly, the spinner apparatus 10 is released from the pipe segment 120. The spinner apparatus 10, along with the torque wrench 134, is now in a position for the installation of a new segment of drill pipe on the top end of the pipe segment 120. The drill string can then be lowered into the well for the installation of a new section of drill pipe.

As can be seen, the present invention facilitates the installation of the pipe segment into the well pipe. Initially, since the pipe segment 120 only needs to move to within the reach area of the frame of the spinner apparatus 10, it is not necessary for a worker to manually manipulate the pipe segment so as to be within the center of the spinner apparatus. The present invention avoids the dangers and injuries that are possible when the worker manipulates the heavy pipe segment 120 by hand. It is possible for the worker to simply manipulate the wire connection of the elevator to the pipe segment 120 to be in the desired position. Accuracy of positioning of the pipe segment 120 within the spinner apparatus 10 is not necessary in the present invention. The accuracy of placement is accomplished by the relationship of arms, roller and claw members, as described herein. Furthermore, this relationship of arms, rollers and claw members assures that the pipe segment 120 will be in its desired position centrally above the torque wrench 134 and above the well pipe 122, of the diameter of the pipe. The rollers will close together so as to centralize a small diameter pipe. In the present invention, the spinner apparatus 10 will not need to be manipulated in the horizontal direction relative to the torque wrench 138. The spinner apparatus 10 will always remain centralized over the gripping area of the torque wrench 138. Since the present invention utilizes driven rollers, as opposed to chains, the present invention avoids the dangers associated with such chain driven operations. The present invention enhances pipe installation efficiency and improves pipe installation safety.

Figure 14:
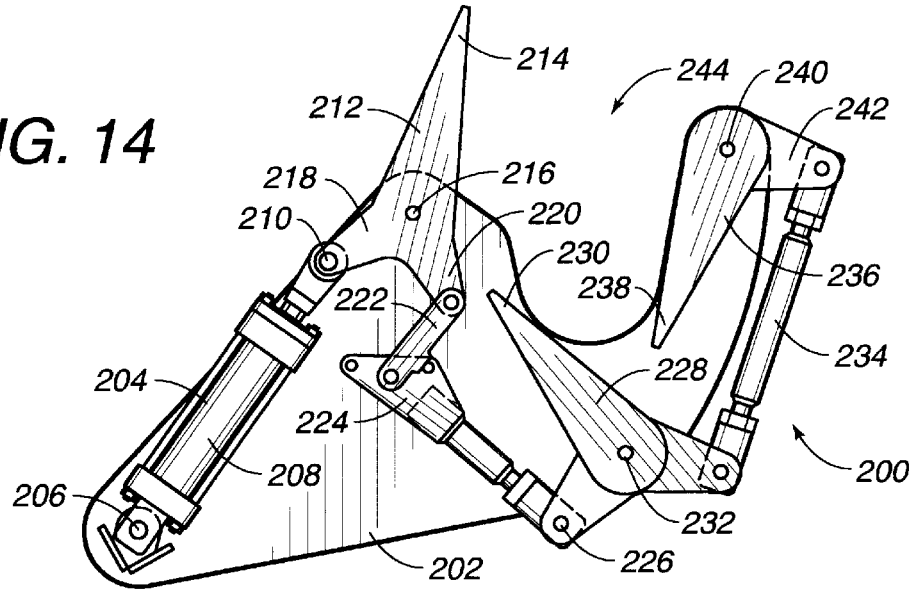
FIG. 14 is a plan view showing a centralizer in accordance with an alternative form of the present invention in a position prior to receiving a pipe segment therein.

Referring to FIG. 14, there is shown at 200 an alternative embodiment of the present invention in which the apparatus 200 performs as a "centralizer" for the centering of a pipe segment. In FIG. 14, the apparatus 200 includes a frame 202 having an actuator 204 pivotally connected at 206 thereto. The actuator 204 is of a configuration described herein previously of a cylinder 208 having a piston rod 210 extending therefrom. The piston rod 210 is connected to first arm 212. The first arm 212 has a claw member 214 extending outwardly therefrom. The first arm 212 is pivotally connected at 216 to the frame 202. A lever 218 is pivotally connected to the end of the piston rod 210. Similarly, a link arm 220 extends outwardly from the opposite side of the pivot point 216 from the claw member 214. The link arm 220 is pivotally connected to a link member 222 which is, in turn, pivotally connected to a pull rod arm 224. Pull rod arm 224 is pivotally connected at 226 to a second arm 228. Second arm 228 has a claw member 230 extending outwardly therefrom. The second arm 228 is pivotally connected at 232 to the frame 202. The second arm 228 has synchronization linkage 234 extending to the third arm 236. The third arm 236 includes a claw member 238. The third arm 236 is pivotally connected at 240 to the frame 202. The third arm 236 has a synchronization lever 242 which is connected to synchronization linkage 234. In FIG. 14, it can be seen that there is a reach area 244 formed within a U-shaped indentation of the frame 202. Each of the claw members 214, 230 and 238 of the respective arms 212, 228 and 236 are arranged in a desired arrangement around the reach area 244. It can be seen that the claw member 214 extends outwardly of the reach area 244 so as to draw a pipe segment into the reach area in a coordinated manner.

It can be seen in FIG. 14 that the configuration of the present invention has the same construction as described herein previously, but for the use of the rollers and the associated motors. As such, the centralizer 200 can serve with a purpose of centralizing a pipe segment in coordination with the use of a conventional spinner apparatus or in conjunction with the use of a torque wrench. As such, if desired, the centralizer 200 can be used in conjunction with the structure shown in FIGS. 6–13.

Figure 15:
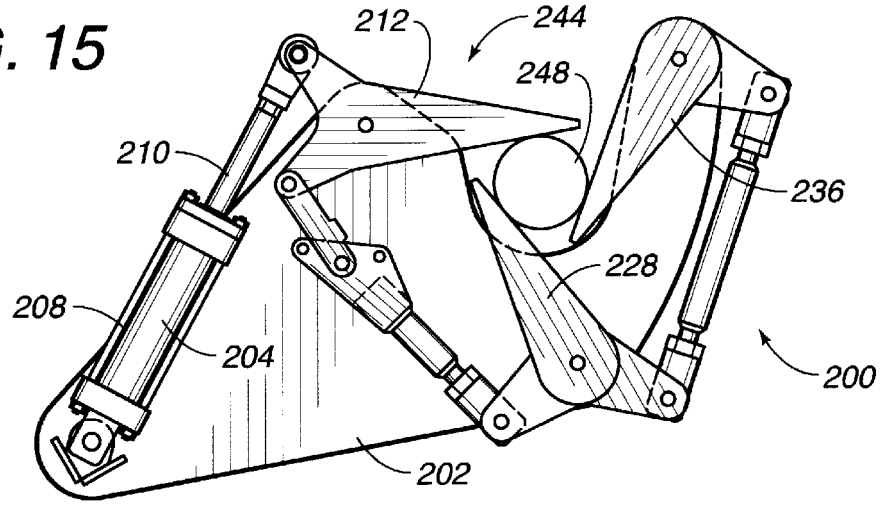
FIG. 15 shows a plan view of the centralizer are receiving a large diameter pipe segment.

FIG. 15 illustrates how a large diameter pipe segment 248 is received between the arms 212, 228 and 236 within the reach area 244. The piston rod 210 will extend outwardly a desired distance from the cylinder 208 of actuator 204. This will cause a pivoting of the arm 212 so that the claw member 214 initially starts to draw the large diameter pipe segment 248 into the reach area 244. Simultaneously, the second arm 228 and the third arm 236 will move inwardly into the reach area 244 so as to contact the outer diameter of the pipe segment 248. As such, the pipe segment 248 will be centrally received within the reach area 244.

Figure 16:
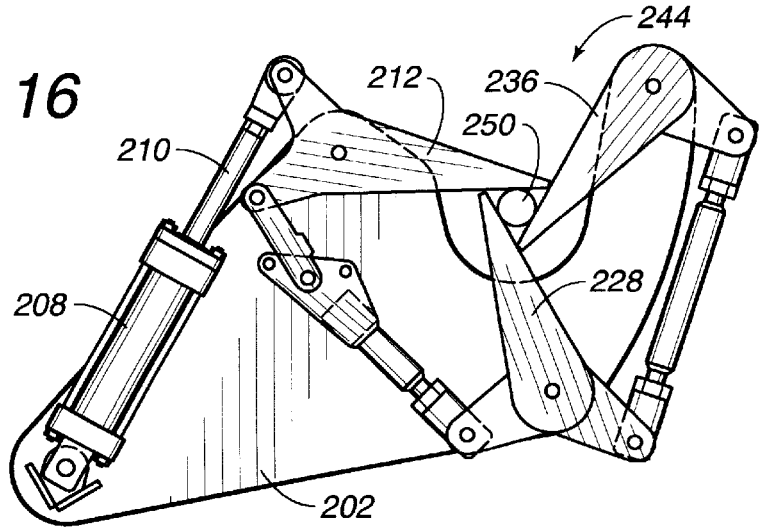
FIG. 16 is a plan view of the centralizer as receiving a small diameter pipe segment.

FIG. 16 shows how the apparatus 200 can be used for the centering of a small diameter pipe segment 250. The action will occur in the same manner as described in conjunction with FIG. 15. It can be seen that the piston rod 210 extends outwardly from the cylinder 208 a further distance than that shown in FIG. 15. As such, the first arm 212 will pivot further at the same time as the second arm 228 and the third arm 236 also pivot further. The small diameter pipe segment 250 will move along the edges of each of the arms 212, 228 and 236 so as to be centered within the reach area 244. As can be seen, the pipe segments 248 and 250 are suitably centered regardless of the diameter of the pipe segments.

The foregoing disclosure and description of the invention is illustrative and explanatory thereof. Various changes in the details of the illustrated constructions or in the steps of the described method may be made within the scope of the appended claims without departing from the true spirit of the invention. The present invention should only be limited by the following claims and their legal equivalents.

I claim:

1. An apparatus for installing a pipe segment in a well pipe comprising:

a frame having a reach area formed therein;

a first arm pivotally connected to said frame;

a first roller rotatably mounted on said first arm;

a second arm pivotally connected to said frame;

a second roller rotatably mounted on said second arm, said second arm being linked to said first arm so as to cause said second roller to move toward said reach area as said first roller moves into said reach area;

a third arm pivotally connected to said frame;

a third roller rotatably mounted to said third arm, said third arm being linked to said second arm such that the movement of said second roller toward said reach area causes said third roller to move toward said reach area; and an actuator being linked to at least one of said arms, said actuator adapted to pivot one of said arms such that the respective roller on said arm moves into said reach area, each of said arms being linked together such that each of said arms moves concomitantly with the other arms upon an actuation by said actuator, said rollers being adapted to position the pipe segment within said reach area such that a central longitudinal axis of the pipe segment is located at an identical location within said reach area regardless of a diameter of the pipe segment.

2. The apparatus of claim 1, said actuator adapted to move said arms such that said rollers contact a surface of the pipe segment in said reach area with a longitudinal axis of the pipe segment being radially spaced equally from an axis of rotation of each of said rollers.

3. The apparatus of claim 2, each of said rollers having an equal diameter.

4. The apparatus of claim 1, said first arm having a claw member extending outwardly from a side of said first roller opposite a point of pivotal connection of said first arm with said frame, said claw member extending outwardly beyond a diameter of said first roller.

5. The apparatus of claim 4, said second arm having a claw member extending outwardly from a side of said second roller opposite a point of pivotal connection of said second arm with said frame, said third arm having a claw member extending outwardly from a side of said third roller opposite a point of pivotal connection of said third arm with said frame.

6. The apparatus of claim 1, said first arm having a lever connected to said actuator and a link arm connected to a linkage extending to said second arm, said lever and said link arm extending outwardly from said first arm on a side of a point of pivotal connection of said first arm with said frame opposite said first roller.

7. The apparatus of claim 6, said linkage comprising:

a link member pivotally connected to said link arm of said first arm; and a pull rod arm having one end pivotally connected to an end of said link member opposite said link arm, said pull rod arm having an opposite end pivotally connected to said second arm at an end of said second arm opposite said second roller.

8. The apparatus of claim 7, said second arm having a lever connected to said opposite end of said pull rod arm, said second arm having a link arm connected by a synchronization lever to said third arm, said lever and said link arm of said second arm extending from a side of a point of pivotal connection of said second arm opposite said second roller.

9. The apparatus of claim 8, said third arm having a pull rod lever extending outwardly from a side of a point of pivotal connection of said third arm with said frame opposite said third roller, said synchronization lever being pivotally connected to said pull rod lever of said third arm.

10. The apparatus of claim 1, said actuator being a hydraulic cylinder with a piston rod extending outwardly therefrom, said hydraulic cylinder having an end pivotally connected to said frame, said piston rod having an end pivotally connected to said first arm.

11. The apparatus of claim 1, said frame being affixed to a vertical shaft such that said frame extends outwardly transverse to said vertical shaft, said frame being movable along said shaft during an installation of the pipe segment into the well pipe.

12. The apparatus of claim 11, said vertical shaft being supported upon a displaceable base, said vertical shaft having a torque wrench extending outwardly therefrom below said frame.

13. An apparatus comprising:

a well pipe having a central longitudinal axis;

a pipe segment having an end adapted for receipt within said well pipe;

a frame having a reach area formed therein;

a plurality of arms linked together and pivotally mounted on said frame;

three rollers respectively mounted on said plurality of arms, each of said three rollers having a central axis, said central axis of each of said three rollers being spaced by an equal distance from each other regardless of a diameter of said pipe segment; and an actuator connected to said plurality of arms and adapted to move said plurality of arms such that said pipe segment is received between said three rollers such that a central longitudinal axis of said pipe segment is in alignment with said central longitudinal axis of said well pipe regardless of a diameter of said pipe segment.

14. The apparatus of claim 13, each of said plurality of arms having a claw member extending outwardly therefrom beyond an edge of the respective roller.

15. The apparatus of claim 13, further comprising:

a motor drivingly connected to at least one of said three rollers, said motor adapted to drive one of said three rollers so as to rotate said pipe segment around said longitudinal axis of said pipe segment.

16. The apparatus of claim 13, further comprising:

a vertical column extending upwardly from a base, said frame being connected to said vertical column such that said frame extends outwardly transversely thereto, said frame being translatable along said vertical column as said pipe segment is received in said well pipe.

17. The apparatus of claim 16, further comprising:

a torque wrench connected to said vertical column and extending outwardly therefrom, said torque wrench having a grip area engageable with said pipe segment and said well pipe, said torque wrench positioned below said frame.

18. The apparatus of claim 17, said actuator being adapted to move said three rollers so as to receive said pipe segment in a position central of said grip area of said torque wrench regardless of the diameter of said pipe segment.

19. A method of installing a pipe segment into an end of a well pipe comprising:

suspending the pipe segment such that a longitudinal axis of said pipe segment is vertically oriented;

positioning the suspended pipe segment into a reach area of a spinner, said spinner having a plurality of arms pivotally connected to a frame and a plurality of rollers rotatably mounted respectively on said plurality of arms, said plurality of arms being linked together, at least one of said plurality of arms having a claw member extending outwardly therefrom;

actuating said spinner such that said claw member draws said pipe segment into said frame such that said longitudinal axis of said pipe segment is aligned with a longitudinal axis of said well pipe; and rotating said pipe segment by said spinner such that an end of said pipe segment is threadedly received within the end of the well pipe.

20. The method of claim 19, said step of actuating comprising:

moving said plurality of arms such that said pipe segment is received in frictional contact between said plurality of rollers.

21. The method of claim 20, said step of rotating further comprising:

moving said frame vertically downwardly as said pipe segment is received within the end of the well pipe.

22. The method of claim 19, further comprising:

closing a bottom clamp of a torque wrench around a surface of said well pipe;

closing a top clamp of said torque wrench around a surface of said pipe segment; and rotating said top clamp with respect to said bottom clamp such that an end of said pipe segment is securely received within the end of the well pipe.

23. The method of claim 22, each of said top and bottom clamps defining a grip area therein, said step of actuating comprising:

moving said plurality of rollers such that a center of said plurality of rollers is aligned vertically with a center of said grip area without moving said frame.

24. An apparatus for centering a pipe segment comprising:

a frame having a reach area formed therein;

a first arm pivotally connected to said frame;

a second arm pivotally connected to said frame and linked to said first arm so as to cause said second arm to move toward said reach area as said first arm moves into said reach area;

a third arm pivotally connected to said frame and linked to said second arm such that a movement of said second arm toward said reach area causes said third arm to move into said reach area; and an actuator being linked to at least one of said arms, said actuator adapted to pivot one of said arms such that the respective arm is movable into said reach area, each of said arms being linked together such that each of said arms moves concomitantly with the other arms upon an actuation by said actuator, said arms being adapted to position the pipe segment within said reach area such that a central longitudinal axis of the pipe segment is located at an identical location within said reach area regardless of a diameter of the pipe segment.

25. The apparatus of claim 24, said actuator adapted to move said arms such that an edge of said arms contacts a surface of said pipe segment in said reach area with a longitudinal axis of said pipe segment being radially spaced equally from said edge of each of said respective arms.

* * * * *